US005718273A

United States Patent [19]

Best et al.

[11] Patent Number: 5,718,273

[45] Date of Patent: Feb. 17, 1998

[54] BLINDS WITH IMPROVED DECORATIVE LOUVERS

[75] Inventors: Blake D. Best; Mark W. Harding, both of Cincinnati, Ohio

[73] Assignee: Dennis J. Redic, Atlanta, Ga.

[21] Appl. No.: 835,323

[22] Filed: Apr. 7, 1997

Related U.S. Application Data

[63] Continuation of Ser. No. 853,124, Mar. 18, 1992, abandoned, which is a continuation-in-part of Ser. No. 810,187, Dec. 19, 1991, abandoned.

[51] Int. Cl.[6] ..... E06B 9/26

[52] U.S. Cl. ..... 160/166.1; 160/236; 160/900

[58] Field of Search ..... 160/236, 168.1, 160/176.1, 900, 166.1, 173, 172

[56] References Cited

U.S. PATENT DOCUMENTS

| | | | |
|---|---|---|---|
| 2,012,034 | 8/1935 | Brent . | |
| 2,074,482 | 3/1937 | Martens . | |
| 2,646,115 | 7/1953 | Butcher et al. . | |
| 3,032,099 | 5/1962 | Croxen | 160/236 X |
| 4,049,038 | 9/1977 | Hyman et al. . | |
| 4,195,680 | 4/1980 | Hyman et al. . | |
| 4,236,566 | 12/1980 | Hensel . | |
| 4,276,954 | 7/1981 | Romano . | |
| 4,292,763 | 10/1981 | Barnes et al. | 160/236 X |
| 4,434,834 | 3/1984 | Ennes | 160/166.1 |
| 4,628,980 | 12/1986 | Le Houillier . | |
| 4,773,733 | 9/1988 | Murphy et al. | 160/236 X |
| 4,884,616 | 12/1989 | Setele . | |
| 4,911,220 | 3/1990 | Hiller . | |
| 4,913,216 | 4/1990 | Lemay . | |
| 4,930,562 | 6/1990 | Goodman | 160/236 |
| 5,094,286 | 3/1992 | Hansen | 160/168.1 |
| 5,105,870 | 4/1992 | Merjane | 160/236 |
| 5,141,042 | 8/1992 | Scwaegerle | 160/236 |

FOREIGN PATENT DOCUMENTS

| | | | |
|---|---|---|---|
| 420367 | 1/1972 | Australia . | |
| 687713 | 6/1964 | Canada . | |
| 848698 | 9/1960 | United Kingdom . | |
| 2163472 | 2/1986 | United Kingdom | 160/236 |

*Primary Examiner*—David M. Purol

*Attorney, Agent, or Firm*—Frost & Jacobs

[57] ABSTRACT

Louvered blinds for use at windows and the like, having vertically or horizontally oriented louvers bearing decorative indicia, and which, when closed, are free of light gaps and free of overlap of the decorative indicia from louver-to-louver. Each louver comprises an elongated slat-like element with a main body portion and an extended lip portion along one longitudinal edge of the main body portion. The decorative indicia on each louver is substantially co-extensive with its main body portion. When the louvers are closed, the lip portion of each louver overlies the rear surface of the next adjacent louver to prevent light gaps while the decorative indicia of each louver is fully exposed to produce the overall decorative image of the closed blind, uninterrupted by overlaps louver-to-louver. In a preferred embodiment, the decorative indicia on each louver can be easily removed therefrom and replaced with other decorative indicia.

22 Claims, 5 Drawing Sheets

BLINDS WITH IMPROVED DECORATIVE LOUVERS

REFERENCE TO RELATED APPLICATION

This is a continuation of application Ser. No. 07/853,124, filed Mar. 18, 1992 now abandoned which, in turn, is a continuation-in-part of application Ser. No. 07/810,187, filed Dec. 19, 1991 now abandoned.

TECHNICAL FIELD

Invention relates to louvered blinds for windows and the like, of the type wherein the louvers are horizontally or vertically oriented and provided with decorative indicia, and more particularly to such blinds which, when closed, yield an overall decorative effect or image uninterrupted by light gaps or indicia overlap.

BACKGROUND ART

Louvered blinds are widely used as window and door treatments. There are two basic types of louvered blinds. In one type, the louvers are vertically oriented and in the second type the louvers are horizontally oriented. The present invention is directed to both types of louvered blinds.

Louvered blinds may be used with any type of opening such as windows, doors or the like. While not intended to be so limited, for purposes of an exemplary showing, the present invention will be described in terms of its application to louvered blinds for windows.

Louvered blinds enhance the aesthetic appeal of a window and provide privacy. When decorating a home or office, it is desirable to coordinate the color of the louvered blinds with the walls, carpet and draperies. It is also desirable to have blinds which, themselves, enhance the decor of the room. Accordingly, it will be appreciated that it would be highly desirable to have blinds the louvers of which, when in closed position, would present some form of decorative indicia to better coordinate with the environment. The term indicia, as used herein and in the claims, is intended to be interpreted broadly to encompass any appropriate type of decorative patterns or images including (but not limited to) letters, designs, portraits, photographs, graphics, etc.

It would be desirable to be able to purchase louvered blinds with, for example, pictures of people or places of interest, as ready made items. A problem arises, however, with conventional blinds having vertical or horizontal louvers. The problem arises from the fact that when the louvers are in their closed position, there is purposeful edge overlap of the louvers to preclude light gaps between the louvers and to assure privacy. Such overlapping, however, would disrupt and distort an overall image presented by the louvers in closed position. To compensate for this, would require high cost together with the use of a large amount of material and a considerable amount of waste in order to make the image complete in spite of overlap. Alternatively, to space the louvers such that, when closed, they aligned edge-to-edge, would unavoidably result in light gaps and less privacy.

The present invention is directed to overcoming the problems set forth above. Briefly, the blinds of the present invention are provided with louvers, each comprising an elongated main body portion with an extended lip portion located along one of its longitudinal edges. When the louvers are in closed position, each presents a front surface (normally facing into the room) and a rear surface (normally facing the window with which the blind is associated). The extended lip portion of each louver, when the louvers are in closed position, overlies the rear surface of the next adjacent louver. This overlap assures privacy and precludes light gaps. The front surface of each louver bears its portion of the overall indicia or image, only on the main body portion thereof. As a consequence, there is no overlap of the image louver-to-louver. It will be understood by one skilled in the art that the blind could be so constructed that the front surfaces of the louvers would face the window, rather than the room, if the image or indicia was intended to be viewed from the outside, rather than from inside the room. Thus, as used herein and in the claims, the phrase "front surface" refers to that surface of each louver bearing the decorative indicia on its main body portion. The phrase "rear surface" refers to the opposite surface of the louver.

It is a further object of the present invention to make the image portion on the main body portion of each louver easily removable and replaceable so that the image presented by the blind, when its louvers are in closed position, can be easily changed.

DISCLOSURE OF THE INVENTION

According to the invention, there is provided a louvered blind for use with windows and the like. The blind may have vertically or horizontally oriented louvers. The louvers bear decorative indicia which, when the louvers are in closed position, presents an overall image free of light gaps and free of disruptive overlap of the decorative indicia from louver-to-louver.

Each louver comprises an elongated slat-like element having a main body portion and an extended lip portion along one side edge of the main body portion. The extended lip portion is preferably an integral, one-piece part of the louver. The decorative indicia of each louver is substantially co-extensive with the main body portion of that louver. When the louvers are in closed position, each extended lip portion overlies the rear surface of the next adjacent louver to prevent light gaps. At the same time, the decorative indicia of each louver is fully exposed to produce the overall decorative effect of the image of the closed blind, uninterrupted by overlaps louver-to-louver.

In a preferred embodiment, each louver comprises a slat-like element, the main body portion of which is delimited by longitudinally extending groove-forming elements. These elements form opposed facing grooves in parallel spaced relationship and extending substantially the length of the louver. The main body portion of the louver and its extended lip portion are preferably opaque, and the longitudinally extending groove forming elements are preferably transparent. While the louvers may be made up of any appropriate materials which will adequately serve the purpose, they are preferably extruded of plastic, utilizing an opaque plastic for the main body portions and the extended lip portions and a transparent plastic material for the groove forming elements. The decorative indicia is formed on an elongated strip-like substrate of appropriate material by any appropriate printing process, photographic process or the like and the indicia bearing strip is so sized as to be just nicely received within and between the groove forming elements, and to be substantially co-extensive with the main body portion of the louver. In this way, the indicia bearing strip of each louver may be removed and replaced, as desired, so as to change the overall indicia or image presented by the blind, when its louvers are in closed position.

DETAILED DESCRIPTION OF THE INVENTION

Figure 1:
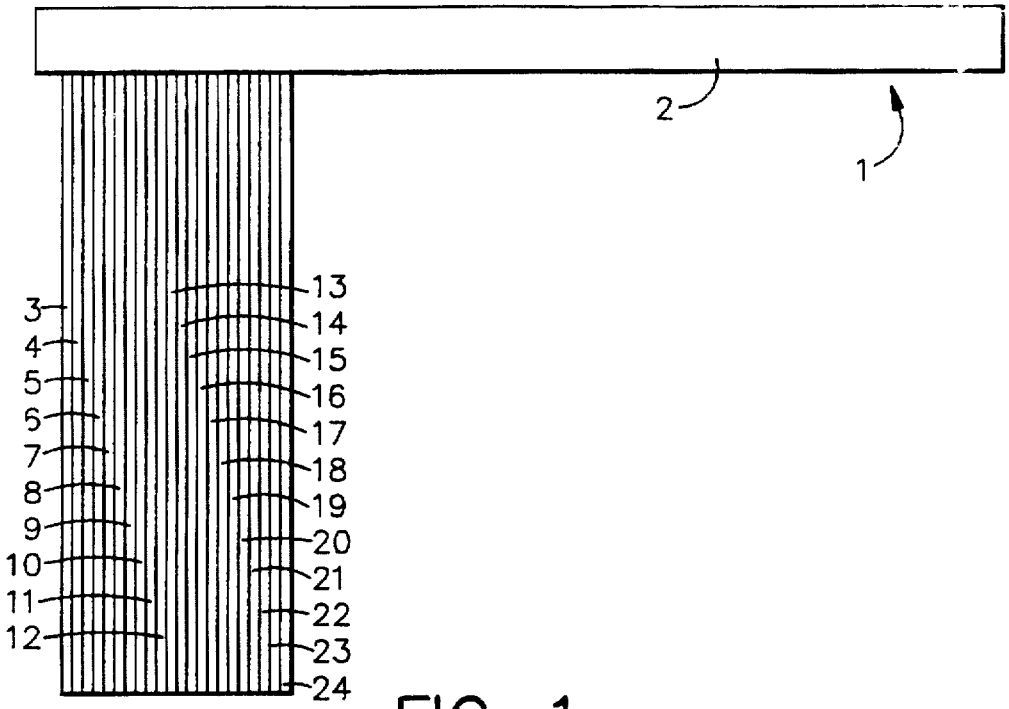
FIG. 1 is an elevational view of a vertical louvered blind made in accordance with the present invention. The louvers are shown in retracted position.
Figure 2:
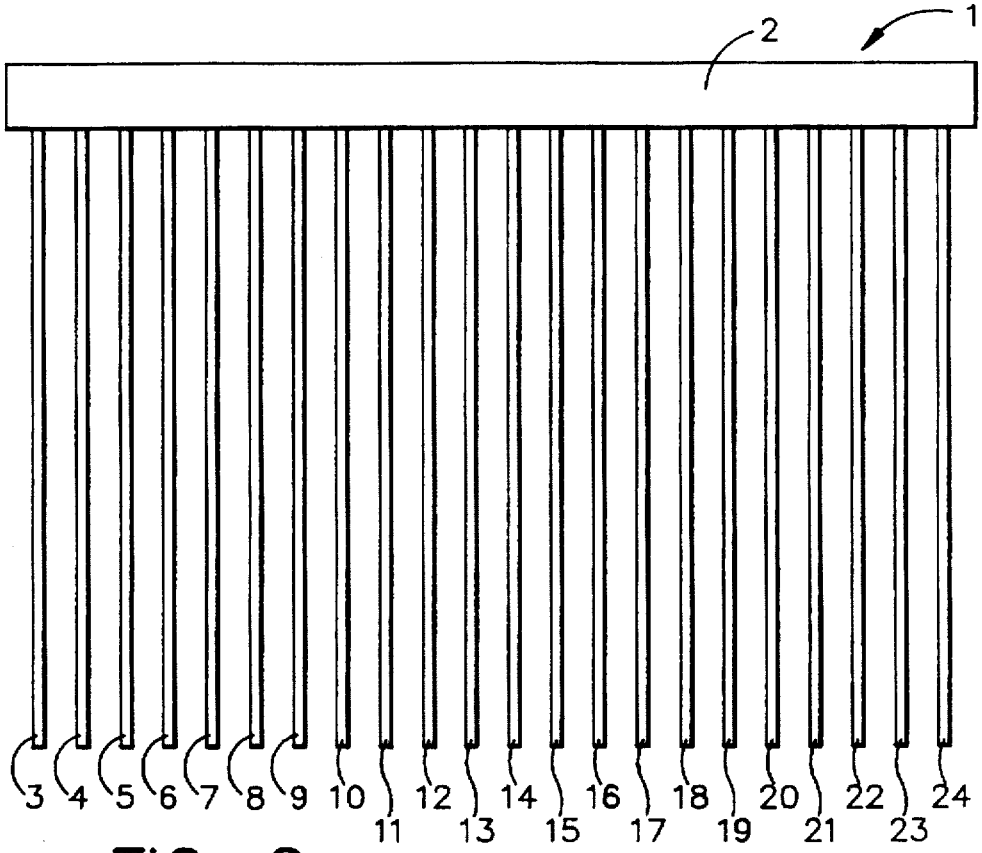
FIG. 2 is an elevational view of the blind of FIG. 1, illustrating its louvers in deployed and open position.
Figure 3:
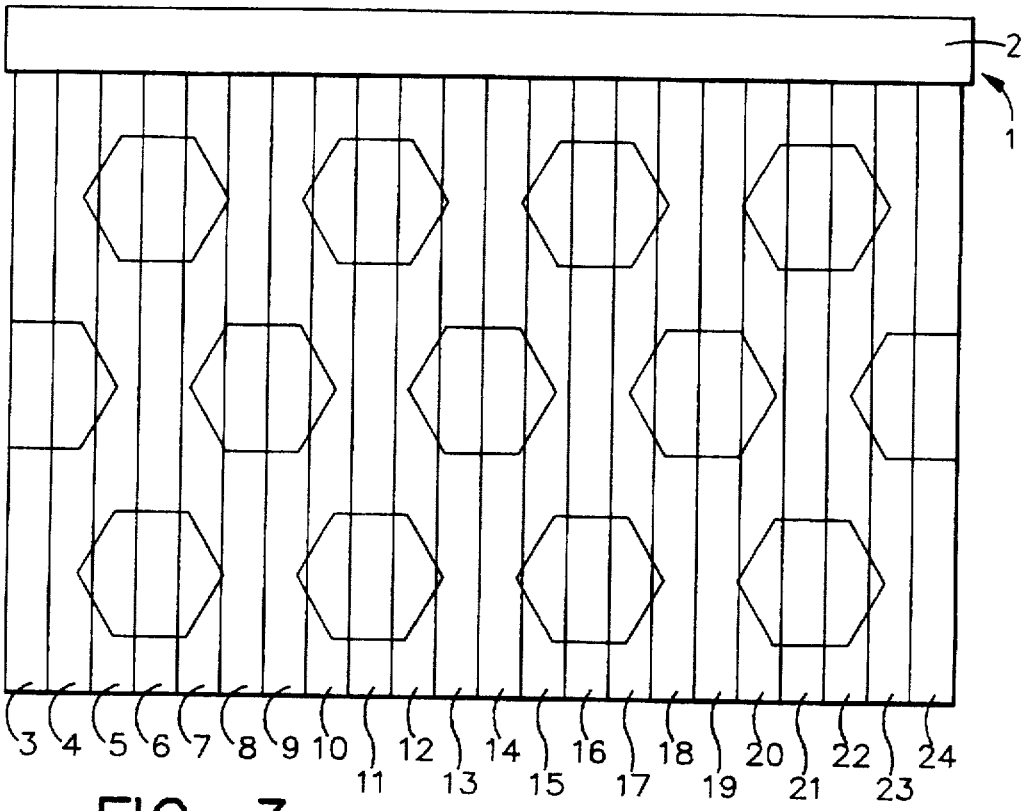
FIG. 3 is an elevational view of the blind of FIG. 1 illustrating the louvers in their deployed, closed and image displaying position.

Reference is first made to FIG. 1, 2 and 3 which illustrate an exemplary blind of the type having vertical louvers made in accordance with the present invention. With the exception of the louver construction, the blind of FIGS. 1 through 3, generally indicated at 1, is substantially conventional. The blind 1 comprises a header 2 from which the louvers 3 through 24 depend. The header 2 contains the carriers (not shown) for the louvers together with the mechanism (not shown) for shifting the louvers to their various positions. The carriers and the shifting mechanism are well-known in the art and do not constitute a part of the present invention.

In all of the views wherein the thickness of the louvers is shown, this thickness is exaggerated for purposes of clarity. In FIG. 1, the louvers are shown in their retracted position, arranged face-to-face and located at one end of the header 2.

In FIG. 2, the slats are shown in their deployed and open position. In this position, the slats 3 through 24 are substantially evenly spaced along header 2 and are still oriented in face-to-face relationship, as shown. In FIG. 3, the louvers 3 through 24 are illustrated in their deployed and closed position, which will be more fully described hereinafter.

In some types of blinds having vertical louvers, the louvers are not retractable to one end of header as shown in FIG. 1. In other words, in this type of blind, the louvers are simply rotatable between the deployed and open position shown in FIG. 2 and the deployed and closed position illustrated in FIG. 3. The teachings of the present invention are applicable to either type of vertical louvered blind.

Figure 4:
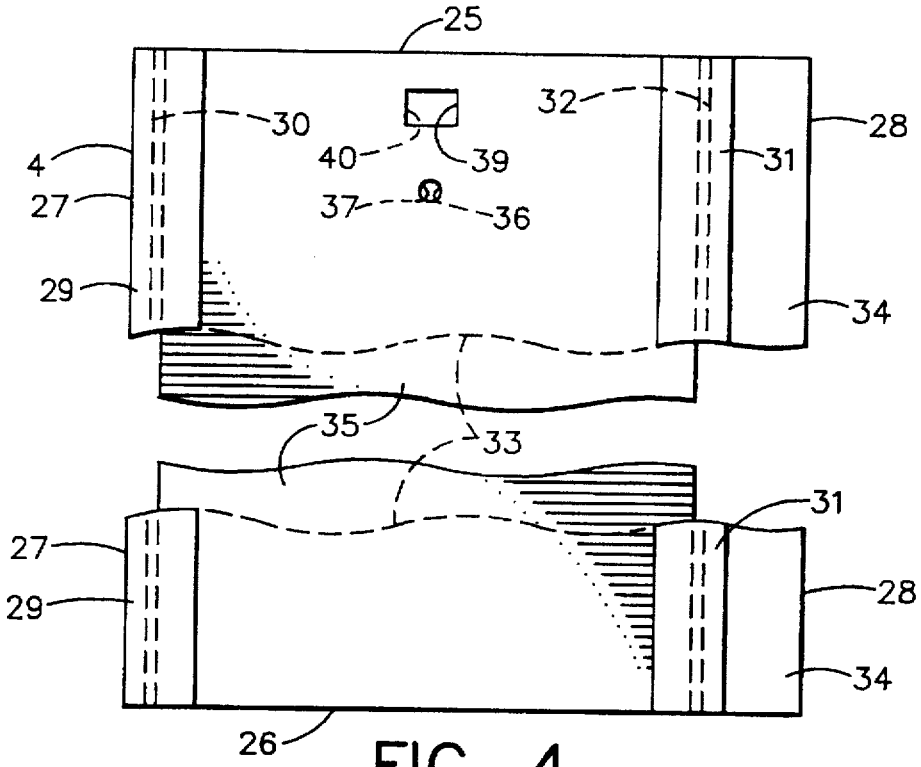
FIG. 4 is a fragmentary elevational view of a louver of the blind of FIGS. 1 through 3.
Figure 5:
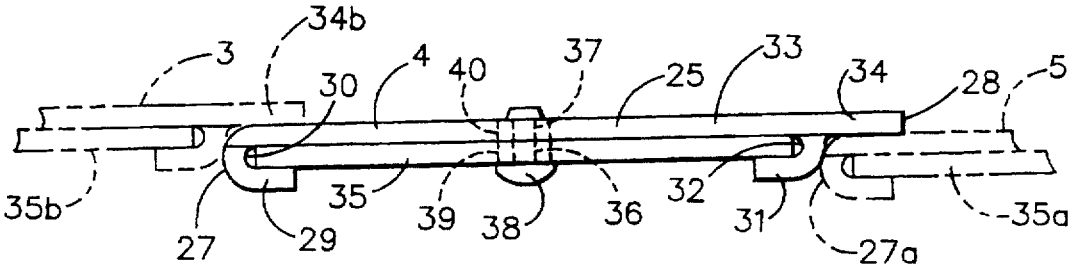
FIG. 5 is a top plan view of the louver of FIG. 4, with adjacent louvers fragmentarily illustrated in broken lines.

Reference is now made to FIGS. 4 and 5, wherein vertical louver 4 is illustrated. Since vertical louvers 3 and 5 through 24 are identical to vertical louver 4, the description of vertical louver 4 will stand as a description of all of the vertical louvers.

Vertical louver 4 comprises an elongated slat-like structure having an upper end 25 and a lower end 26. The louver 4 has longitudinal peripheral edges 27 and 28. Along longitudinal edge 27 there is formed a groove defining element 29 providing groove 30. Inset from the longitudinal edge 28 there is a groove defining element 31 which extends the length of the louver 4 and defines groove 32.

The louver 4 has a main body portion 33 which is defined by the louver end edges 25 and 26 and the groove forming elements 28 and 31. The louver 4 also has an extended longitudinally extending lip portion 34 defined by end edges 25 and 26, longitudinal edge 28 and groove forming element 31.

While dimensions do not constitute a limitation of the present invention, the width of the main body portion 33 may be a conventional louver width such as approximately 3.5 inches (8.89 cm). The longitudinal lip portion 34 may have a width of about ⅜ inch (0.95 cm).

The louver 4 may be made of any appropriate material. In the embodiment illustrated, the main body portion 33 and the extended lip portion 34 should be opaque. The groove forming portions 29 and 30 are preferably transparent. Excellent results have been achieved, for example, by extruding louver 4 from plastic material such as polyvinyl chloride (PVC).

The longitudinally extending, opposed grooves 30 and 32 are adapted to receive a strip 35 bearing decorative indicia. The strip 35 may also be made of any appropriate material such as paper, paper board, plastic (such as polyethylene), and the like. The strip 35 could constitute an appropriate substrate covered with a fabric material or the like. The strip 35 is essentially coextensive with the main body portion of louver 4. In FIG. 5, the thickness of strip 35 has been exaggerated (as has the thickness of the louver 4) for purposes of clarity. The strip 35 has, near the upper end 25 of the louver, a circular opening formed therein. The opening is indicated at 36 in FIGS. 4 and 5. The main body portion 33 of louver 4 has a coaxial perforation 37 (see FIG. 5) formed therein. The perforations 36 and 37 receive a removable plastic snap pin 38 which serves to prevent longitudinal shifting of the strip 35 within grooves 30 and 32. The strip 35 has a second opening 39 formed therein (see FIG. 4). The main body portion 33 of the slat 4 has a coextensive perforation 40 formed therein (see FIG. 5). The perforations 39 and 40 are adapted to accommodate the conventional hanger 4 for the slat 4. The hanger (not shown) is located within header 2.

When the louvers 3 through 24 are each attached to its respective hanger, they are attached in such a way that when the louvers are in their retracted position as shown in FIG. 1 or their deployed and open position as shown in FIG. 2 the extended lip portions of each louver will face the window (assuming that when the louvers are in their deployed and closed position, the decorative indicia or image is to be viewed from within the room). When the louvers 3 through 24 are rotated from their deployed and opened position illustrated in FIG. 2 to their deployed and closed position illustrated in FIG. 3, the extended lip portion of each louver will overlap the free edge of the adjacent louver from the rear. This is illustrated in FIG. 5. In FIG. 5, louver 4 is shown in full, and the adjacent louvers 3 and 5 are fragmentarily illustrated in broken lines. It will be noted from FIG. 5 that the extended lip portion 34 of louver 4 overlaps the rear surface of the adjacent free end 27*a* of louver 5. Similarly, the extended lip portion 34*b* of louver 3 overlaps the rear surface of the free end 27 of louver 4. This overlapping of each louver by the extended lip portion of the next adjacent louver assures the absence of light gaps and complete privacy.

It will further be noted that the adjacent longitudinal edges of the adjacent indicia bearing strips 35, 35*a* and 35*b* will be substantially side-by-side. It is to be remembered that the thickness of the louvers has been exaggerated in FIG. 5. This will result in an overall image, presented by the blind, which will appear substantially uninterrupted and which will be free of overlap.

The extended lip portion on the endmost slat 24 (see FIG. 3) will have no adjacent louver to overlap. The extended lip portion is relatively narrow and its presence will not be visually disturbing. Alternatively, the louver 24 may be made without an extended lip portion, as shown in FIG. 3.

Figure 6:
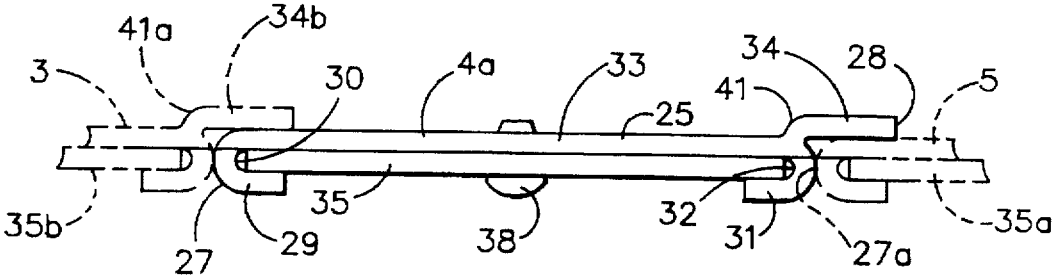
FIG. 6 is a top plan view, similar to FIG. 5, and illustrating another embodiment of vertical louver, with adjacent louvers fragmentarily illustrated in broken lines.

Reference is made to FIG. 6 wherein a slightly modified embodiment of the louvers is illustrated. As in the case of FIG. 5, FIG. 6 illustrates a louver 4*a* flanked by adjacent louvers 3*a* and 5*a*. The louvers 3*a*, 4*a* and 5*a* differ from the louvers 3, 4 and 5 of FIG. 5 only in that their extended lip portions (extended lip portions 34 and 34*b* being shown in FIG. 6), are offset rearwardly as at 41 and 41*a*, respectively, by distance equivalent to the thickness of the main body portion 33. As a result of the offset of the extended lip portions, the main body portion of all of the louvers, when in closed position, will be substantially co-planar, rather than lying at a slight angle, as shown in FIG. 5.

From the above description, it will be apparent that the indicia bearing strips 35, 35*a* and 35*b* can be easily and quickly removed and replaced should they, after a considerable period of time show fading or the like. Alternatively, the strips can be replaced at will for purposes of changing the overall image presented by the blind in closed condition.

To change the strip 35 of louver 4, it is only necessary to disengage the louver from its hanger and to remove the snap-fit pin 38. The strip 35 can then be removed longitudinally from grooves 30 and 32. A new strip can thereafter be placed in the grooves 30 and 32 and locked in place by pin 38. The louver 4 is thereafter reengaged with its hanger and the replacement operation with respect to strip 35 is completed. The indicia bearing strips of the other louvers are changed in a similar fashion. The entire replacement operation is capable of being performed quickly and easily.

Figure 7:
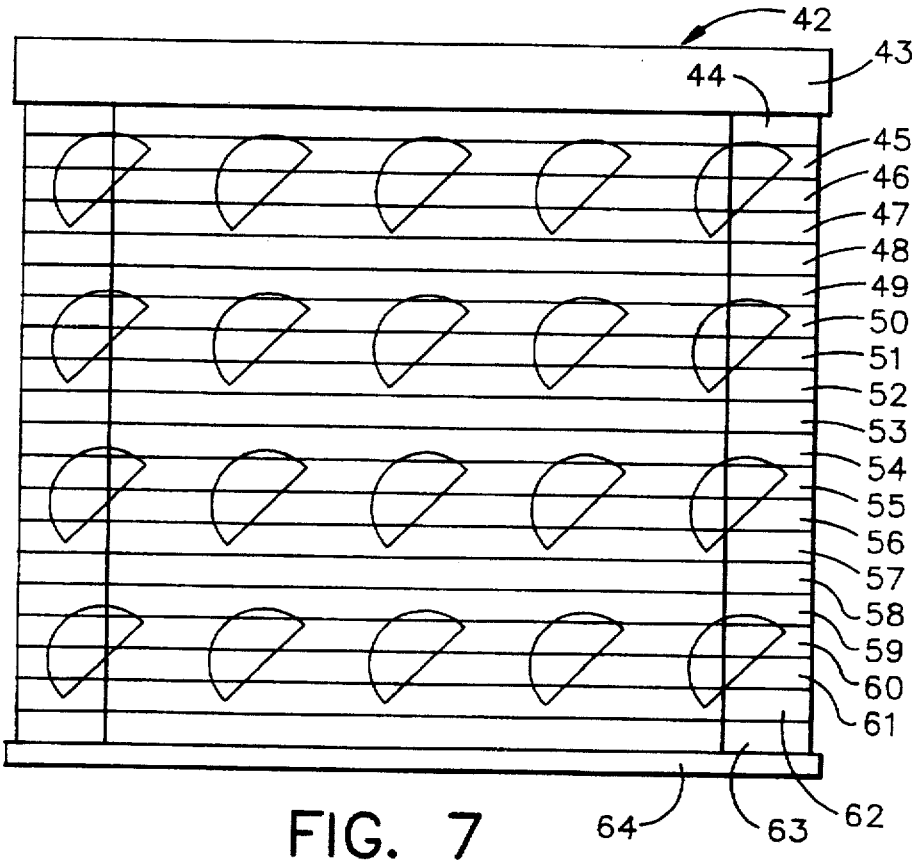
FIG. 7 is an elevational view of a horizontal louvered blind made in accordance with the present invention.

As indicated above, the teachings of the present invention are also applicable to the blinds of the type having horizontally oriented louvers. Such a blind is illustrated in FIG. 7 with its louvers in deployed and closed position. The blind is generally indicated at 42. The header 43 is conventional and contains the necessary mechanism to shift the louvers from their upper retracted position to their lower deployed position and to rotate the louvers between their open position and their closed position. This mechanism (not shown) is conventional and well known in the art. The blind 42 is illustrated as having horizontally oriented louvers 44 through 63. Adjacent the lowermost slat 63 there is a bottom bar 64 which, again, is conventional and well known in the art.

Figure 8:
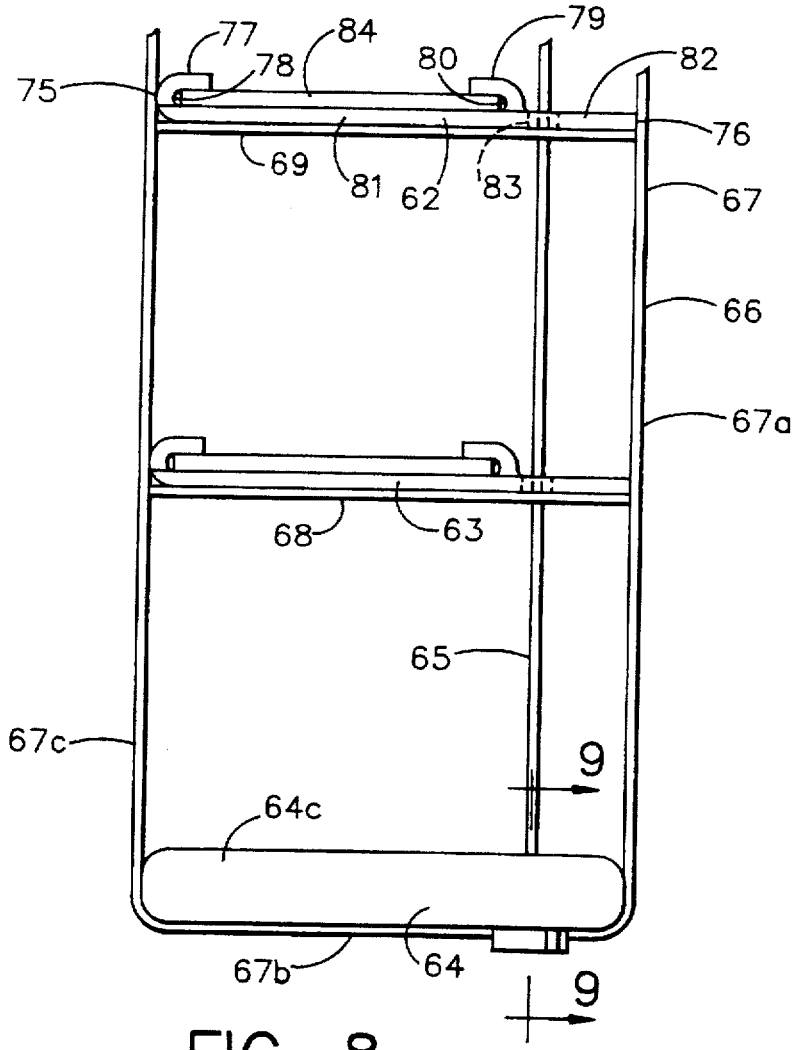
FIG. 8 is a fragmentary side elevational view of the blind of FIG. 7 with the louvers in their deployed and open position.

Referring to both FIGS. 7 and 8, the louvers 44 through 63 are shifted between their uppermost retracted position and their lowermost deployed position by a pair of conventional pull-up strings, one of which is shown at 65 in FIG. 8. The louvers 44 through 63 are supported by a pair of conventional ladders 66 and 662. The ladder 66 is fragmentarily shown in FIG. 8. Conventionally, the ladders are made of fabric or plastic tape or of a string-like material, the latter version being illustrated in FIGS. 7 and 8. Ladders 66 and 662 are identical. As shown in FIG. 8, the ladder 66 comprises a string member 67 having a rearward vertical flight 67*a*, a bottom flight 67*b* and a forward vertical flight 67*c*. The rearward and forward flights 67*a* and 67*c* are joined together by a plurality of string segments, two of which are shown at 68 and 69 in FIG. 8. Each ladder will have a segment similar to segments 68 and 69 for each louver.

Figure 10:
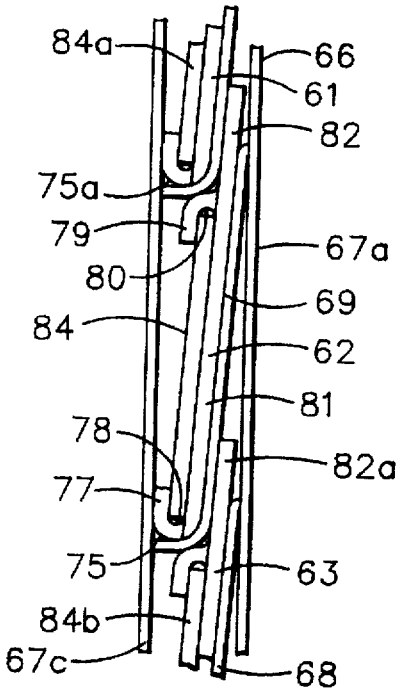
FIG. 10 is a fragmentary side elevational view of the blind of FIG. 7 with the louvers in deployed and closed position.

In FIG. 8, the louvers are shown in their deployed and open position wherein the louvers are oriented in horizontal, parallel spaced relationship. It will be understood that the louvers are held in this relationship by their respective ladder segments 68 and 69. To shift the louvers to their deployed and closed position, as shown in FIG. 7, it is only necessary to shift ladder string segment 67*a* upwardly and ladder string segment 67*c* downwardly until the slats achieve a closed position as shown in FIG. 10 and as will be more fully described hereinafter. To return the louvers to the positions shown in FIG. 8, it is only necessary to shift the rearward string segment 67*a* downwardly and the forward string segment 67*c* upwardly until the louvers attain the horizontal, parallel position shown in FIG. 8. It will be understood that the ladder 662 will function in precisely the same way and the shifting of the ladders will be accomplished through convention mechanism (not shown), well known in the art.

Figure 9:
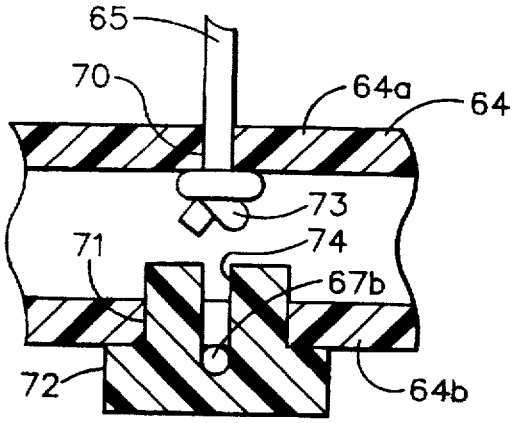
FIG. 9 is a fragmentary cross-sectional view taken along section line 9—9 of FIG. 8.

To raise and lower the louvers between their upward, retracted position and their lower, deployed position, the pull-up strings are employed. Normally, the pull-up strings are located adjacent the ladders. As indicated above, one of the two pull-up strings is shown at 65 in FIG. 8. Pull-up string 65 is attached to bar 64 in any appropriate manner. An exemplary and well-known attachment system is illustrated in FIG. 9. The bar 64 comprises a hollow member having an upper wall 64*a*, and a lower wall 64*b*. The ends of the bar are capped by closure members, one of which is shown at 64*c* in FIG. 8.

The upper wall 64*a* of bar 64 is provided with a perforation 70 at the position at which the pull-up string 65 is to be attached. The bottom wall 64*b* of bar 64 has an opening 71 formed therein and provided with a closure plug 72. During assembly, the pull-up string 65 is inserted through perforation 70 and perforation 71, and has a knot 73 tied therein. The pull-up string is then pulled back through the perforation 71 to a point adjacent the upper wall 64*a*. The knot 73 prevents the pull-up string 65 from passing through perforation 70. In this fashion, the lowermost end of pull-up string 65 is captive within the bar 64. Thereafter, the plug 72 may be replaced in perforation 71. It will be noted that the plug 72 is bifurcated, forming vertical slot 74 therein. The segment 67*b* of ladder 66 is located in the slot 74 during insertion of the plug 72 in perforation 71. This maintains the ladder 66 in proper position with respect to the bar 64. It will be understood that the pull-up string (not shown) adjacent ladder 662 can be mounted in the bar 64 in precisely the same manner, a plug similar to plug 72, being provided to properly position ladder 67 with respect to bar 64.

It will be noted that the louvers 62 and 63 are similar in configuration to the louver 4 of FIG. 5. All of louvers 44 through 63 are identical. Therefore, a description of louver 62 can serve as a description of all of louvers 44 through 63 of FIG. 7. The louver 62 has a forward longitudinal edge 75 and a rearward longitudinal edge 76. Along the forward longitudinal edge 75, the louver is provided with a groove-forming element 77 defining a longitudinally extending groove 78. The groove-forming element 77 extends the length of louver 62. Similarly, inset from rearward longitudinal edge 76, the louver 62 is provided with a groove-forming element 79 extending the length thereof and defining a longitudinal groove 80. That portion of the louver between groove-forming elements 77 and 79, and between the louver ends comprises the main body portion 81 of louver 62. That portion of the louver between the groove-forming element 79, the longitudinal rearward edge 76 and the louver ends comprises an extended lip portion 82. It will be noted that the pull-up string 65 passes through an elongated perforation 83 in the extended lip portion 82, adjacent the groove-forming element 79. It will be understood that the other pull-up string (not shown) will pass through a similar elongated perforation (not shown) in extended lip portion 82.

The grooves 78 and 80 of louver 62 are adapted to receive the longitudinal edges of an indicia bearing strip 84. The materials from which the louver 62 and the strip 84 are made can be any of those materials described with respect to the louver 4 and the strip 35 of FIG. 5.

Reference is now made to FIG. 10. In this Figure, louver 62 is shown in its deployed and closed position. FIG. 10 further fragmentarily illustrates adjacent louvers 61 and 63. For purposes of clarity, the pull-up string 65 of FIG. 8 has been eliminated from FIG. 10.

It will be noted from FIG. 10 that the extended lip portion 82 of louver 62 overlaps the rear surface of the front free edge 75*a* of louver 61. Similarly, the extended lip portion 82*a* of louver 63 overlaps the rear surface of the front longitudinal edge 75 of louver 62. In this fashion, light gaps are precluded between the louvers when in their deployed and closed positions, and privacy is assured. Each of the louvers 61, 62 and 63 carries indicia-bearing strips 84*a*, 84 and 84*b*, respectively. The adjacent longitudinal edges of these indicia-bearing strips lie substantially side-by-side, it being remembered that the thickness of the strips, 84*a*, 84 and 84*b*, as well as the thickness of the louvers 61, 62 and 63, has been exaggerated for purposes of clarity in FIG. 10. As a consequence, when the shade 42 is in its deployed and closed condition as illustrated in FIG. 7, the indicia-bearing strips will provide an overall image which is substantially uninterrupted and free of overlaps.

Figure 11:
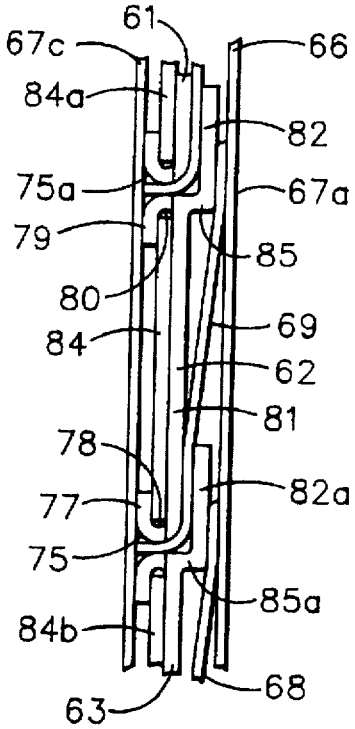
FIG. 11 is a fragmentary side elevational view, similar to FIG. 10, and illustrating another embodiment of louver.

Reference is now made to FIG. 11. FIG. 11 is similar to FIG. 10 and like parts have been given like index numerals. In FIG. 11, the three louvers shown are indicated at 61*a*, 62*a* and 63*a*. The louvers 61*a*, 62*a* and 63*a* differ from the louvers 61, 62 and 63 of FIG. 10 only in that their respective extended lip portions 82 and 82*a* are offset rearwardly, as at 85 and 85*a* by an amount approximating the thickness of the main body portion of the louvers and the thickness of ladder segments 68 or 69. As a result, the main body portions 81, 81*a* and 81*b* of the adjacent louvers 61, 62 and 63 are substantially co-planar as in the case of the louvers 3, 4 and 5 of FIG. 6.

From the above description, it will be apparent that the strips, such as strip 84, bearing the decorative indicia and mounted on each louver can be easily removed from its respective louver and replaced. No disassembly of the blind is required. As is true of all of the strips of all of the louvers, the strip 84 of louver 62 can simply be shifted longitudinally from between the grooves 78 and 80. In similar fashion, a new strip can be inserted longitudinally within the grooves 78 and 80. In this way, the decorative indicia or scene presented by the blind in its closed position can be quickly and easily changed.

Figure 12:
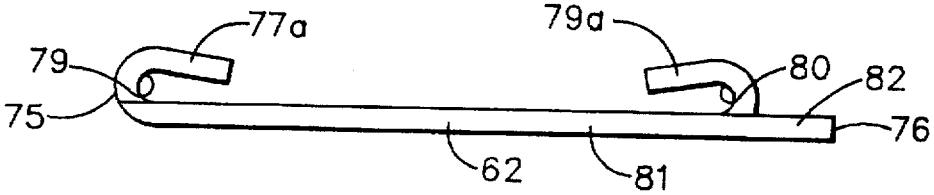
FIG. 12 is an end elevational view of another embodiment of louver for use with the blind of FIG. 7.

Depending upon the nature of the material from which the indicia bearing strips are made, it may be desirable to provide a slight frictional fit between the strip and its respective louver to prevent undesirable longitudinal shift of the strip with respect to its louver. FIG. 12 illustrates the louver 62. Again, all of its parts have been given the same index numerals. In this instance, however, the slot forming elements have been indicated at 77*a* and 79*a*. These slot forming elements differ from those illustrated in FIGS. 8, 10 and 11 in that they slope slightly downwardly and inwardly. As a result, when the strip 84 is inserted in the slots 79 and 80, it will be slightly frictionally engaged between the main body portion 87 and the slot forming elements 77*a* and 79*a*.

Figure 13:
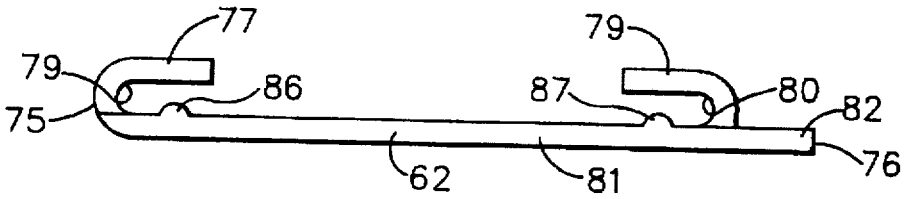
FIG. 13 is an end elevational view of yet another embodiment of louver for use with the blind of FIG. 7.

Another friction forming means is illustrated in FIG. 13. Again, the louver 62 is illustrated and all of its parts have been given the same index numerals. In this instance, however, the louver 62, near its ends, is provided with a pair of small bumps 86 and 87. The bumps (not shown) at the other end of the louver will be identical. As a result of this, the strip 84, when inserted in the grooves 79 and 80 will be slightly frictionally engaged between the bump 86 and the slot forming element 77 and the bump 87 and the slot forming element 79. The same sort of frictional engagement will be provided at the other end of the louver by that pair of bumps, not shown.

It will be understood by one skilled in the art that the uppermost louver 44 (see FIG. 7) will have a lip portion which does not overlap an adjacent louver. The lip on louver 44 will not detract from the overall appearance of the blind 42. On the other hand, the uppermost louver 44 could be fabricated without an extended lip, if desired.

It would be within the scope of the present invention to eliminate the groove-forming elements on either the vertical or horizontal louvers of the present invention. For example, the groove forming elements 29 and 31 could be eliminated from the vertical louver 4. Similarly, the groove-forming elements 77 and 79 could be eliminated from the horizontal louver 62. In such an instance, the decorative indicia would be applied directly to the main body portion 33 of louver 4 or the main body portion 81 of louver 62. This could be done by gluing or otherwise adhering a strip directly to the main body portion, or by silk screening or otherwise imprinting the decorative indicia directly on the main body portion. Horizontal or vertical louvered blinds of the present invention with the indicia fixed directly to the main body portions of the louvers would again have the advantages of no overlap of indicia, no light gaps and complete privacy. Such blinds, however, would not provide quick change over of indicia, as described above.

In either instance, the provision of the extended lip on the horizontal or vertical louvers will enable the blinds to show a complete image without disruptive overlap. In addition, since the main body portions of the louvers are essentially edge-to-edge, fewer louvers will be required per blind.

Modifications may be made in the invention without departing from the spirit of it.

We claim:

1. A blind for a window or other appropriate opening, said blind comprising a plurality of louvers and means to shift said louvers between open and closed positions, each louver comprising an elongated slat-like element with front and rear surfaces, each louver having a main body portion extending the length thereof with longitudinal edges and an extended lip portion along one of said longitudinal edges, said main body portion and said extended lip portion being substantially coplanar and of the same thickness, the front surface of some at least of said louvers bearing decorative indicia mounted on and coextensive with said main body portion thereof, said extended lip of each louver overlapping the rear surface of the next adjacent louver when said louvers are in said closed position to provide privacy and to prevent light gaps therebetween, said louvers in said closed position having their main body portions fully exposed with the main body portions of adjacent louvers having their adjacent longitudinal edges in edge-to-edge relationship with no overlap of said decorative indicia.

2. The blind claimed in claim 1 wherein said louvers are vertically oriented.

3. The blind claimed in claim 1 wherein said louvers are horizontally oriented.

4. A blind for a window or other appropriate opening, said blind comprising a plurality of louvers and means to shift said louvers between open and closed positions, each louver comprising an elongated slat-like element with front and rear surfaces, each louver having a main body portion extending the length thereof with longitudinal edges and an extended lip portion along one of said longitudinal edges, the front surface of some at least of said louvers bearing decorative indicia mounted on and coextensive with said main body, portion thereof, said extended lip of each louver overlapping the rear surface of the next adjacent louver when said louvers are in said closed position to provide privacy and to prevent light gaps therebetween, said louvers in said closed position having their main body portions fully exposed with the main body portions of adjacent louvers having their adjacent longitudinal edges in edge-to-edge relationship with no overlap of said decorative indicia, said main body portion and said extended lip portion of each louver being substantially parallel, with said extended lip portion being offset rearwardly of said main body portion, so that said main body portions of said louvers are substantially co-planar when said louvers are in said closed position.

5. The blind claimed in claim 4 wherein said louvers are vertically oriented.

6. The blind claimed in claim 4 wherein said louvers are horizontally oriented.

7. A blind for a window or other appropriate opening, said blind comprising a plurality of louvers and means to shift said louvers between open and closed positions, each louver comprising an elongated slat-like element with front and rear surfaces, each louver having a main body portion extending the length thereof with longitudinal edges and an extended lip portion along one of said longitudinal edges, the front surface of some at least of said louvers having on their front surfaces groove forming elements extending along said longitudinal edges of said main body portion, said groove forming elements defining opposed grooves in parallel spaced relationship, a strip removably and replaceably mounted within said grooves and being substantially coextensive with said main body portion, said strip bearing said decorative indicia, said extended lip of each louver overlapping the rear surface of the next adjacent louver when said louvers are in said closed position to provide privacy and to prevent light gaps therebetween, said louvers in said closed position having their main body portions fully exposed with the main body portions of adjacent louvers having their adjacent longitudinal edges in edge-to-edge relationship with no overlap of said decorative indicia.

8. The blind claimed in claim 7 wherein said main body portion and said extended lip portion of each louver are opaque, and said groove forming elements thereof are transparent.

9. The blind claimed in claim 8 wherein each said louver is vertically oriented and has upper and lower ends, removable pin means passing through said strip and said main body portion near said upper end of said louver to retain said strip in position within said grooves.

10. The blind claimed in claim 8 wherein said louvers are horizontally oriented and are located within conventional ladders, said blind being provided with conventional pull-up strings passing through elongated holes in said extended lip portion of each of said louvers near said adjacent groove forming element thereof.

11. The blind claimed in claim 8 wherein each of said louvers is horizontally oriented, said groove forming elements of each louver being configured to frictionally engage said edges of said strip between said main body portion and said groove forming elements to prevent undesirable longitudinal shifting of said strip within said grooves.

12. The blind claimed in claim 8 wherein each of said louvers is horizontally oriented and has end portions, near each of said end portions said main body portion has a bump formed therein within each of said grooves to frictionally engage said strip to prevent undesirable longitudinal shifting thereof within said grooves.

13. The blind claimed in claim 8 wherein each of said louvers, including said main body portion, said extended lip and said groove forming elements thereof are extruded of plastic material.

14. The blind claimed in claim 8 wherein said main body portion and said extended lip portion are substantially co-planar.

15. The blind claimed in claim 8 wherein said main body portion and said extended lip portion of each louver are substantially parallel, with said extended lip portion being offset rearwardly of said main body portion so that said main body portions of said louvers are substantially co-planar where said louvers are in said closed position.

16. A louver for use in a louvered blind of the type applied to windows and other appropriate openings, said louver comprising an elongated slat-like element with front and rear surfaces, said louver having a main body portion extending the length thereof with longitudinal edges and an extended lip portion along one of said longitudinal edges, groove forming elements extending along said longitudinal edges of said main body portion thereof, said groove forming elements defining opposed grooves in parallel spaced relationship, a strip removably and replaceably mounted within said grooves and being substantially co-extensive with said louver main body portion, said strip bearing said decorative indicia, said louver, when applied to a blind, having an open position and a closed position, said extended lip overlapping the rear surface of the next adjacent louver when the louver is in its closed position to provide privacy and to prevent light gaps between louvers, said louver in said closed position having its main body portion fully exposed with its longitudinal edges in edge-to-edge relationship with the longitudinal edges of the main body portion of adjacent louvers with no overlap of said decorative indicia.

17. The louver claimed in claim 16 comprising a vertical louver in use.

18. The louver claimed in claim 16 comprising a horizontal louver in use.

19. The louver claimed in claim 16 wherein said main body portion and said extended lip portion are opaque, and said groove forming elements are transparent.

20. The louver claimed in claim 19 wherein said main body portion, said extended lip and said groove forming elements all constitute an integral, one-piece structure extruded of plastic material.

21. The louver claimed in claim 19 wherein said main body portion and said lip portion are substantially co-planar.

22. The louver claimed in claim 19 wherein said main body portion and said lip portion are substantially parallel, said lip portion being offset rearwardly with respect to said main body portion.

* * * * *